US007753334B2

(12) United States Patent
Schreiber

(10) Patent No.: US 7,753,334 B2
(45) Date of Patent: Jul. 13, 2010

(54) WINDOW SAFETY BRACKET

(76) Inventor: James L. Schreiber, PMB No. 229, 3527 S. Federal Way, Suiter 103, Boise, ID (US) 83705

( * ) Notice: Subject to any disclaimer, the term of this patent is extended or adjusted under 35 U.S.C. 154(b) by 148 days.

(21) Appl. No.: 12/208,012

(22) Filed: Sep. 10, 2008

(65) Prior Publication Data

US 2009/0188174 A1 Jul. 30, 2009

Related U.S. Application Data

(60) Provisional application No. 61/023,181, filed on Jan. 24, 2008.

(51) Int. Cl.
*E04G 25/00* (2006.01)

(52) U.S. Cl. ..... 248/351; 52/213; 52/127.2; 248/354.4; 248/354.5; 248/354.6; 182/60; 182/172

(58) Field of Classification Search ..... 182/36–38, 182/53, 58, 150, 60–62, 80, 156, 165, 170, 182/172, 177; 248/354.1, 354.3, 354.4, 354.5, 248/354.6, 236; 52/127.2, 213, 351
See application file for complete search history.

(56) References Cited

U.S. PATENT DOCUMENTS

| | | | | | |
|---|---|---|---|---|---|
| 1,531,159 | A * | 3/1925 | Timmons | 248/236 |
| 1,665,991 | A | 4/1928 | Stramaglia | |
| 1,897,810 | A | 2/1933 | Mallory et al. | |
| 1,957,184 | A * | 5/1934 | Smith | 248/236 |
| 2,914,813 | A * | 12/1959 | Christian et al. | 52/127.2 |
| 3,027,686 | A * | 4/1962 | Oates | 52/127.2 |
| 3,171,508 | A * | 3/1965 | Scott | 182/58 |
| 3,327,983 | A * | 6/1967 | Snapp | 248/354.4 |
| 4,068,427 | A * | 1/1978 | Camardo | 52/127.2 |
| 5,253,839 | A * | 10/1993 | McClure | 248/354.1 |
| 5,682,961 | A * | 11/1997 | Sotomayor et al. | 182/142 |
| 6,026,932 | A * | 2/2000 | Comp | 182/150 |
| 6,233,877 | B1 | 5/2001 | Monroe | |
| 6,910,312 | B2 * | 6/2005 | Whitworth | 52/741.3 |
| 6,926,241 | B2 | 8/2005 | Garrett | |
| 7,040,059 | B2 * | 5/2006 | Hodsdon et al. | 52/127.2 |
| 7,185,739 | B1 | 3/2007 | Blehm | |
| 2007/0107329 | A1 * | 5/2007 | Ferrara | 52/203 |

FOREIGN PATENT DOCUMENTS

JP 08246661 A * 9/1996

* cited by examiner

*Primary Examiner*—Jeanette Chapman
(74) *Attorney, Agent, or Firm*—Robert L. Shaver; Dykas, Shaver & Nipper, LLP

(57) ABSTRACT

The invention is a window safety harness which can be clamped to the frame of a window and which provides a solid anchor point for a person working around the window. The device includes a bar for placement inside the window, a bar for placement outside the window, and a connecting piece which holds the bars in rigid, spaced apart relation to each other. Each end of both the inside and the outside bar have contact pads which are configured to contact the window frame. They also include a tightening mechanism which tightens the contact pads against the window frame and secures the device in the window frame. An anchor point allows a worker to attach himself to the anchor point for work outside the window, or to anchor a line to the window frame.

8 Claims, 5 Drawing Sheets

WINDOW SAFETY BRACKET

CROSS-REFERENCE TO RELATED APPLICATIONS

This application claims the priority date of the provisional application entitled WINDOW SAFETY BRACKET filed by James L. Schreiber on Jan. 24, 2008, with application Ser. No. 61/023,181.

FIELD OF THE INVENTION

The invention is a window anchor for use when installing windows in a new building, or when working around windows at any time.

BACKGROUND OF THE INVENTION

When workers install windows in the second story of a building, they preferably install the window from the inside of the house. The window has a fixed pane of glass, and a sliding pane of glass. The sliding pane of glass can be removed, which is done for installation. The window is positioned in the frame and secured to the frame. A worker has to use a ladder scaffold, or stand on the rough framing or roof to work on the outside of the window to finish the outside part of the installation. The danger is that while he is working on the outside parts of the installation, the worker can fall from the elevated work area.

SUMMARY OF THE INVENTION

The invention is a device which the workers put in the window as it is being installed which provides an anchor point for the worker on the outside of the building. The device is an H-shaped bracket with the ends of the H being extendable, as in telescoping. One bar of the device is placed inside the window and it extends from one side of the window to the other and fits against the window frame on the two sides. The other bar of the device is outside the window and contains an anchor point for the outside worker to clip into. There are adjustments on the legs to tighten the bracket against the door. The H-shape allows the bracket to be tightened against the window frame like a C clamp.

The device is a window safety clamp for use on a window frame and attaches to the window frame of the building. The window frame has an interior surface and an exterior surface. The window safety clamp of the invention includes an inside window frame bar with a first and a second end. Attached to the ends of the inside window frame bar are frame contact pads. These are for contacting and securing the window safety clamp to the interior window frame surface. This bar is configured for generally horizontal placement in a window frame. The contact pads can contact the window frame itself or the safety clamp can be secured to the reinforced area of framing adjacent to the window frame. The inside window frame bar can be a telescoping bar made of three pieces. These three pieces are the middle section and a left and a right section with the left and right sections designed to telescope in and out of the middle section in order to adjust for differently sized windows.

The device also includes an outside window frame bar which is configured generally similar to the inside window frame bar and can be telescoping in design.

On the left and right sides are located tightening mechanisms such as threaded rods which tighten a left and right contact pad against the window frame or the adjacent area.

This tightening device can be on any of the ends of the inside and outside window frame bars but is preferably on the ends of the inside window frame bar.

The device also includes a connecting piece which joins the inside and outside window frame bars, and holds them at a fixed distance from each other in a spaced apart relationship.

Built into the connecting piece is a safety harness anchor point for use by a worker who is working adjacent to the window. By clipping into the safety harness anchor point when the window safety clamp is attached to a window opening, the worker is safeguarded against falling to the ground from the elevated work surface. The device can also be used as a rescue device. One of the devices can be set up to anchor a zip line to another building, and people within the building can use the zip line to escape a burning building, or to rappel or be lowered to another floor or to the ground.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
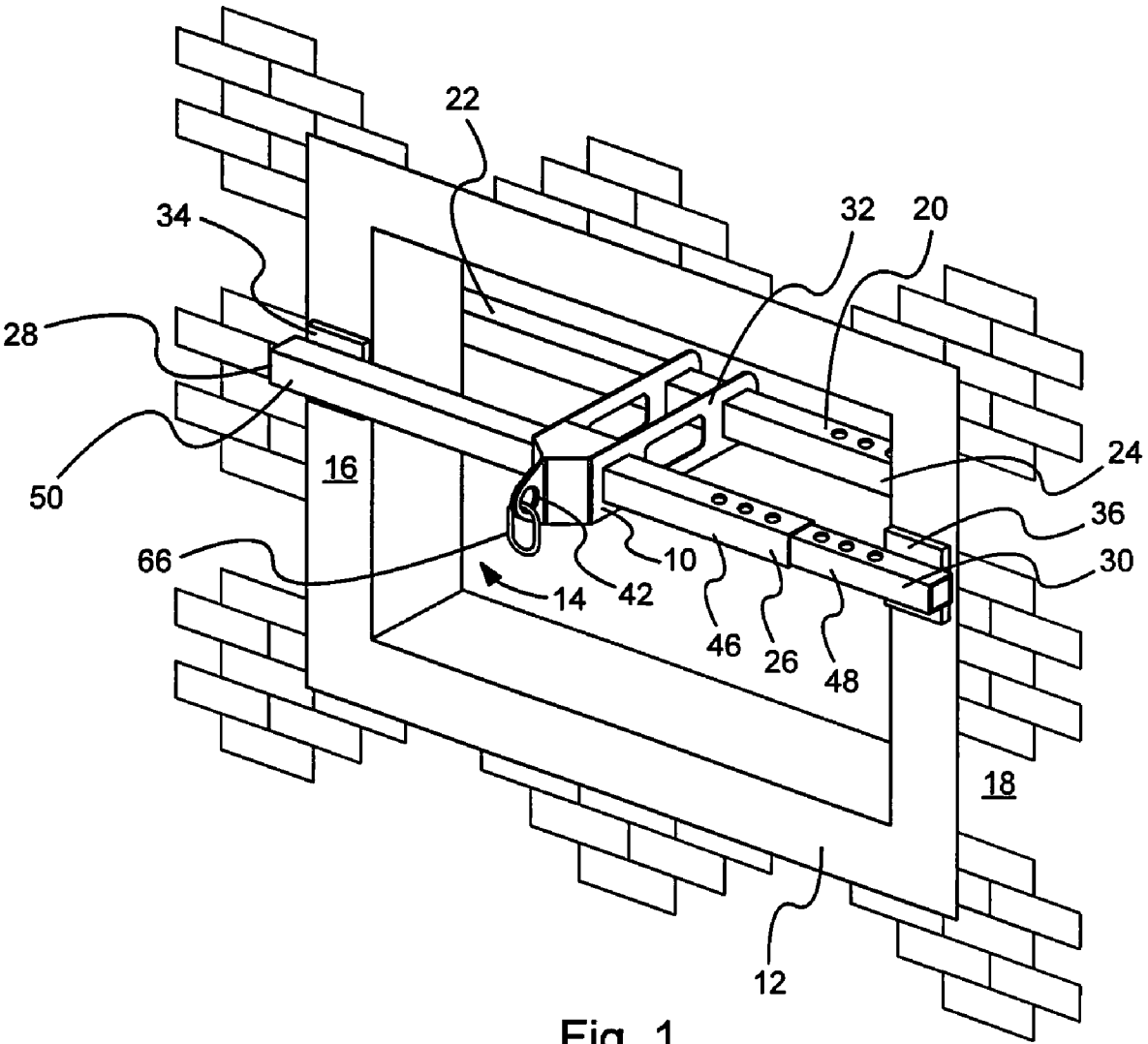
FIG. 1 is a perspective drawing of the safety bracket of the invention mounted in a window.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Shown in FIGS. 1-6 are several preferred embodiments of the invention. The invention is a window safety clamp 10 which is shown in FIG. 1 attached to a window frame 12 in a building wall 18. The window frame 12 includes an exterior window frame surface 16 and an interior window frame surface 14. The window safety clamp 10 includes an interior window clamp bar 20 and an exterior window clamp bar 26. The interior of the clamp bar includes a first end 22 and a second end 24. The exterior window clamp bar 26 includes a first end 28 and a second end 30. The two window clamp bars are connected by a connecting piece 32. The interior window clamp bar and the exterior window clamp bar each include a first contact pad 34 and a second contact pad 36. In FIG. 1, only the second contact pads 36 are visible. The device 10 includes a safety anchor point 42 to which is attached, in the case of FIG. 1, a carabiner 66. FIG. 1 shows a design of the device which includes a middle section 46 and a left telescoping section 48 and a right telescoping section 50.

Figure 2:
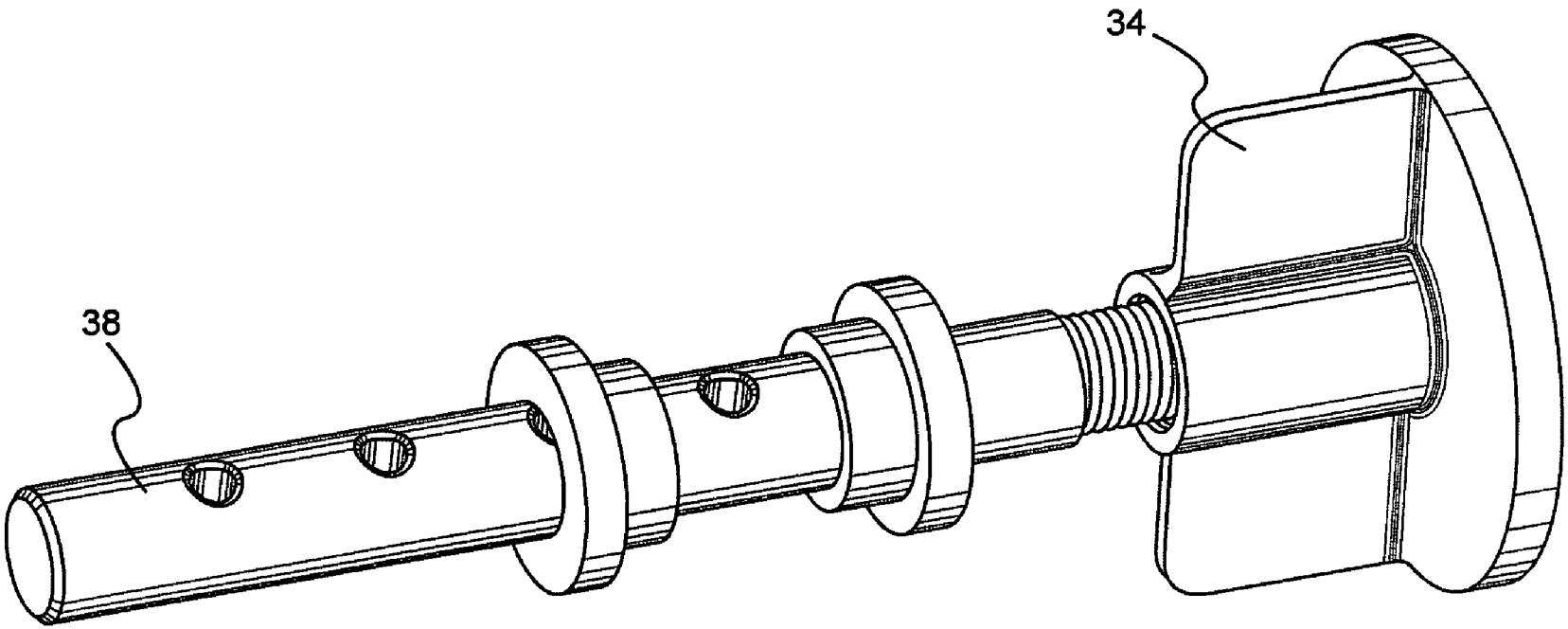
FIG. 2 is a perspective drawing of a tightening mechanism of the invention.

FIG. 2 shows one version of a tightening mechanism 38. A tightening mechanism is provided on each end of the device. The two tightening mechanisms are designated a first tightening mechanism 38 and a second tightening mechanism 40. It can be readily seen that having the tightening mechanism on the interior window clamp bar makes it more convenient to adjust and tighten the window safety clamp 10 from inside the window. From a design standpoint, the first and second tightening mechanisms 38 and 40 can obviously be positioned on the interior window clamp bar or the exterior window clamp bar, or one may be on one end of an interior window clamp bar and the other may be on the opposite end of the exterior window clamp bar. FIG. 2 shows one version of a tightening mechanism 38 with a first contact pad 34. In this version of the device, the tightening mechanism is adjusted using a tool in holes in the shaft which are used to extend the contact pad 34 towards or away from the opposite contact pad.

Figure 3:
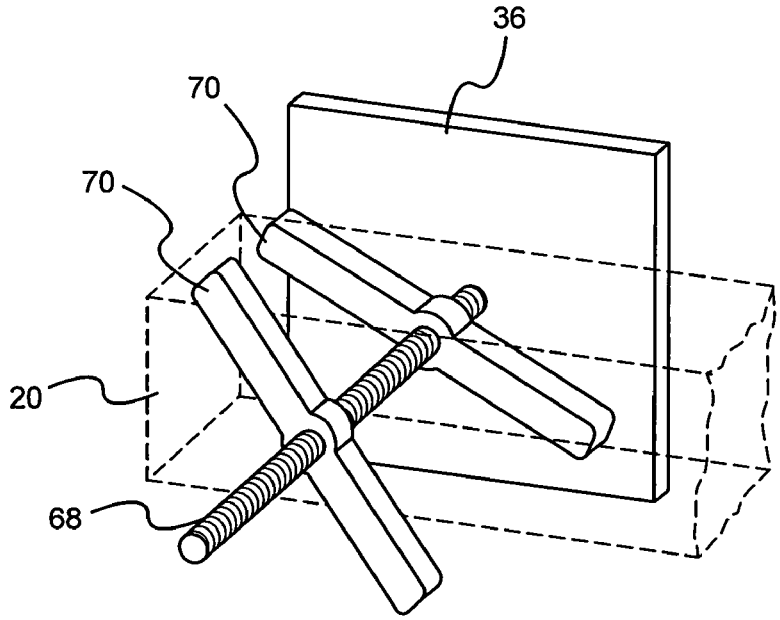
FIG. 3 is a perspective drawing of another type of tightening mechanism of the invention.

FIG. 3 shows an alternate version of a tightening mechanism 38. This version of the tightening mechanism includes a contact pad 36 which is attached to a threaded bolt 68. The threaded bolt 68 passes through an interior window clamp bar 20. Threaded adjusters 70 are positioned on the threaded bolt 68 and serve to extend the first or second window clamp bar contact pad against the interior window frame surface 14.

Figure 4:
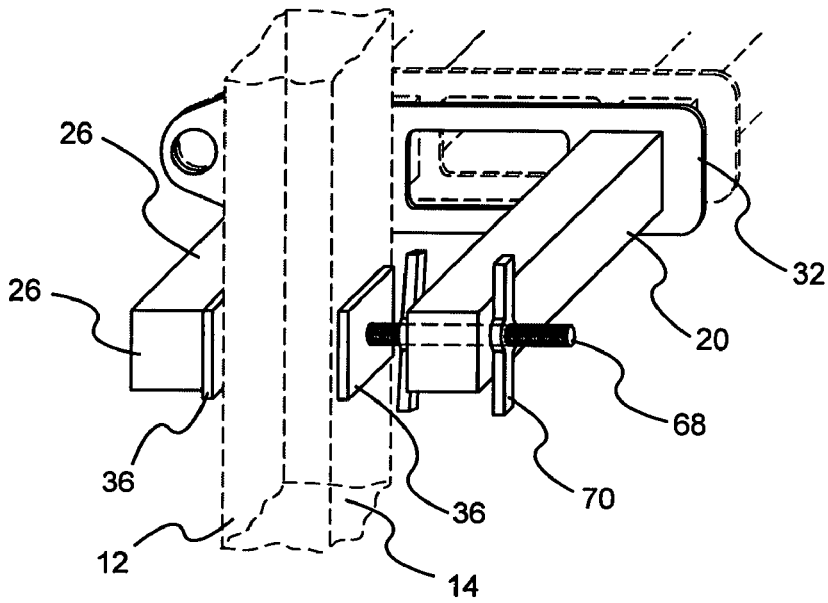
FIG. 4 is a perspective drawing of the window safety bracket of the invention attached to a window.

A perspective view of the tightening mechanism 38 shown in FIG. 3 is shown in FIG. 4.

Figure 5:
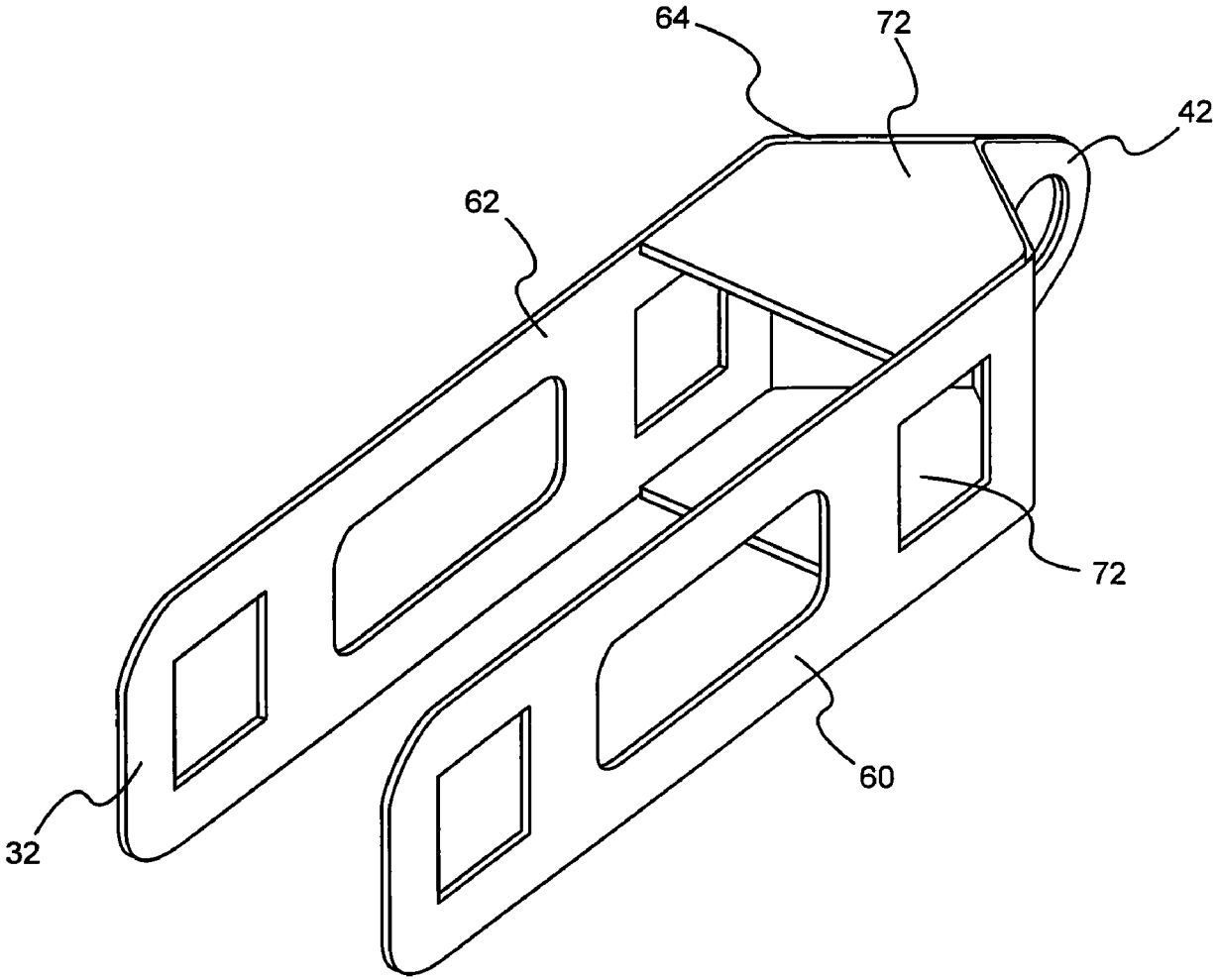
FIG. 5 is a perspective view of the safety harness anchor point of the invention.

FIG. 5 is a perspective view of one version of a connecting piece 32. This piece has a first blade 60, and a second blade 62, and a generally V-shaped section which joins them. The two plates shown in FIG. 5 can be separate pieces of metal and can be joined by a linkage such as a carabiner passing through holes in the region of the V-shaped section 64. The first and second blades, 60 and 62, can also be physically and permanently joined together as shown in FIG. 5, and have a safety harness anchor point 42 which adds strength and rigidity to the device.

Figure 6:
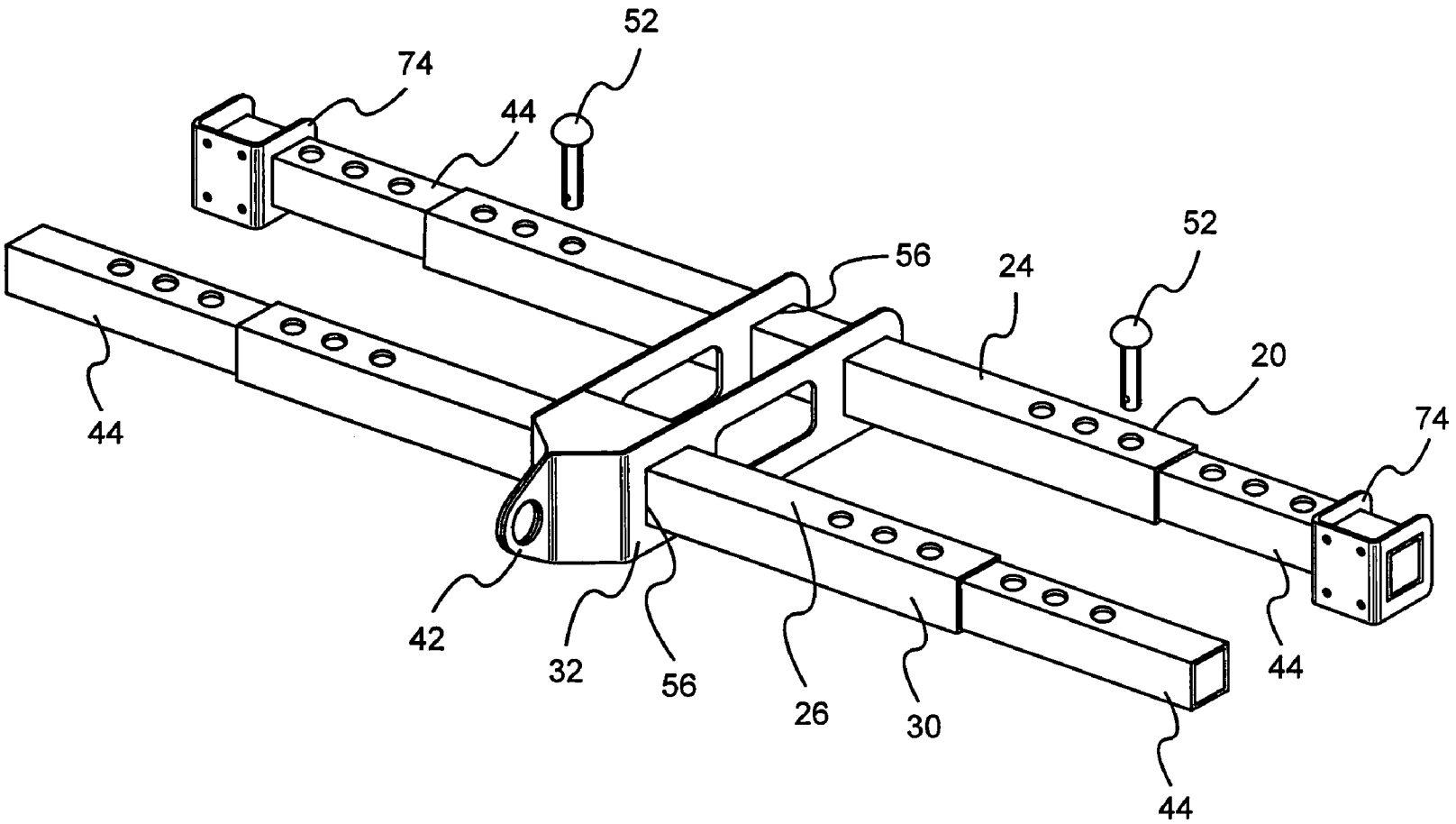
FIG. 6 is a perspective view of the invention.

FIG. 6 shows a version of the device in a partially assembled form. This version shows the window clamp bars 20 and 26 formed as two piece units with a telescope extension 44 which extends out of the interior window clamp bar 20 and the interior window clamp bar 26. The telescope extensions 44 would typically have a securing pin 52 which would typically be a clevis pin with a split ring securing device. Obviously, other forms of securing pins are possible, such as: a nut and bolt or a device similar to a caribiner. Shown in FIG. 6 are bar passages 56 through which the window clamp bars 20 and 26 are extended. The device can include a contact pad base 74 to which the contact pad 34 and 36 are attached. One version of the contact pad base 74 is of the type shown in FIG. 6 which slides over the window clamp bar 20, first and second end 22 and 24.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A window safety clamp for use on a window frame, said window frame comprising an interior window frame surface and an exterior window frame surface, the window safety clamp comprising:

an inside window frame bar, with a first end and a second end, comprising inside frame contact pads attached to said first and second ends for contacting and securing said window safety clamp to said interior window frame surface, with said inside window frame bar configured for horizontal placement adjacent to a window frame;

an outside window frame bar, with a first end and a second end, comprising outside frame contact pads attached to said first and second ends and configured for placement on said window frame opposite said inside frame contact pads with said window frame between said contact pads, said outside frame contact pads for contacting and securing said window safety clamp to said interior window frame surface, with said outside window frame bar configured for horizontal placement adjacent to a window frame;

a window frame bar connecting piece, for holding said inside and outside window frame bars in a parallel and spaced apart relationship;

a tightening mechanism, for applying force to said window frame and for securing said window frame bars by compression against said window frame; and a safety harness anchor point, for use by a worker adjacent to said window; wherein said inside window frame bar is configured for placement adjacent to said interior frame surface, with said inside contact pads contacting said window frame, and with said outside window frame bar configured for placement adjacent to said exterior frame surface, with said outside contact pads contacting said window frame, with said inside window frame bar and said outside window frame bar being secured to said window frame by compression from said tightening mechanism.

2. The window safety clamp of claim 1, in which said tightening mechanism comprises a left and right contact pad tightener, for applying force to a left and a right contact pad so that said left and right contact pads may tighten against said window frame and secure said safety clamp by compression to said window frame.

3. The window safety clamp of claim 1 in which said inside and outside window frame bars telescope in order to adjust in size for different size windows.

4. The window safety clamp of claim 3 in which said inside and outside window frame bars are comprised of a middle section and a left and a right section, with left and right sections configured to telescope in and out of said middle section in order to adjust in size for differently sized windows.

5. The window safety clamp of claim 1 in which said connecting piece is a bracket with passages through which said window frame bars pass, with said connecting piece configured to slide over said left and right window frame bars.

6. The window safety clamp of claim 2 in which said contact pad tighteners comprise threaded adjuster on said ends of said inside window frame bar.

7. The window safety clamp of claim 1 in which said safety harness anchor point is on said connecting piece.

8. A window safety clamp for use on a window frame, said window frame comprising an interior window frame surface and an exterior window frame surface, the window safety clamp comprising:

an inside window frame bar, with a first end and a second end, and comprised of a middle section and a left and a right section, with left and right sections configured to telescope in and out of said middle section in order to adjust in size for differently sized windows, with said inside window frame bar further comprising inside frame contact pads attached to said first and second ends, for contacting and securing said window safety clamp to said interior window frame surface, with said inside window frame bar configured for horizontal placement adjacent to a window frame;

an outside window frame bar, with a first end and a second end, and comprised of a middle section and a left and a right section, with left and right sections configured to telescope in and out of said middle section in order to adjust in size for differently sized windows, with said outside window frame bar further comprising outside frame contact pads attached to said first and second ends, and configured for placement on said window frame opposite said inside frame contact pads with said window frame between said contact pads, said outside frame contact pads for contacting and securing said window safety clamp to said interior window frame surface, with said outside window frame bar configured for horizontal placement adjacent to a window frame;

a window frame bar connecting piece, for holding said inside and outside window frame bars in a parallel and spaced apart relationship;

a tightening mechanism in the form of a left and right contact pad tightener, for applying force to said window frame and for securing said window frame bars by compression against said window frame;

and a safety harness anchor point—for use by a worker adjacent to said window; wherein, said inside window frame bar is configured for placement adjacent to said interior frame surface, with said inside contact pads contacting said window frame, and with said outside window frame bar configured for placement adjacent to said exterior frame surface, with said outside contact pads contacting said window frame, with said inside window frame bar and said outside window frame bar being secured to said window frame by compression from said tightening mechanism.

* * * * *